United States Patent [19]

Fayolle

[11] Patent Number: 4,719,970

[45] Date of Patent: Jan. 19, 1988

[54] PLATE EXCHANGERS AND NOVEL TYPE OF PLATE FOR OBTAINING SUCH EXCHANGERS

[75] Inventor: Lucien Fayolle, Le Vinoux, France

[73] Assignee: Vicarb, France

[21] Appl. No.: 938,338

[22] Filed: Dec. 3, 1986

Related U.S. Application Data

[63] Continuation of Ser. No. 719,468, Apr. 3, 1985, abandoned.

[30] Foreign Application Priority Data

Apr. 19, 1984 [FR] France ..... 8406442

[51] Int. Cl.[4] ..... F28F 3/08

[52] U.S. Cl. ..... 165/166

[58] Field of Search ..... 165/166

[56] References Cited

U.S. PATENT DOCUMENTS

| | | | |
|---|---|---|---|
| 3,265,129 | 8/1966 | Bawabe | 165/166 |
| 3,313,343 | 4/1967 | Ware et al. | 165/166 |
| 3,986,549 | 10/1976 | Huggins et al. | 165/166 |
| 4,099,928 | 7/1978 | Norback | 165/166 |
| 4,125,153 | 11/1978 | Stoneberg | 165/166 |
| 4,263,967 | 4/1981 | McNab et al. | 165/166 |
| 4,378,837 | 4/1983 | Ispelt | 165/166 |
| 4,501,321 | 2/1985 | Real et al. | 165/166 |
| 4,550,773 | 11/1985 | Martin | 165/166 |

FOREIGN PATENT DOCUMENTS

| | | | |
|---|---|---|---|
| 0044561 | of 0000 | European Pat. Off. | 165/166 |
| 838466 | 7/1981 | United Kingdom . | |

*Primary Examiner*—Albert W. Davis, Jr.
*Assistant Examiner*—Peggy Neils
*Attorney, Agent, or Firm*—Parkhurst & Oliff

[57] ABSTRACT

The invention relates to a heat exchanger incorporating independent circuits, constituted by modular elements in the form of blocks maintained juxtaposed inside an enclosure defining independent chambers for each of the fluids. Each block presents superposed channels opening out alternately into the lateral fluid circulation chambers, these channels being defined by the space between the pressed plates, comprising edges turned back through 90° alternately in opposite directions and which form, in each angle, a vertical edge enabling them to be fixed to the lateral walls defining the fluid circulation chambers. The plates are associated with one another by butt-welding of the ends of the bent edges and the vertical-edges.

18 Claims, 10 Drawing Figures

PLATE EXCHANGERS AND NOVEL TYPE OF PLATE FOR OBTAINING SUCH EXCHANGERS

This is a continuation of application Ser. No. 719,468 filed Apr. 3, 1985 now abandoned.

BACKGROUND OF THE INVENTION

The present invention relates to a novel type of heat exchanger incorporating plates; it also relates to the plates for making such an exchanger.

Heat exchangers developed up to the present time may be classified in two major categories, namely tubular exchangers and plate exchangers.

Plate exchangers are generally constituted by stacking a determined number of ribbed plates, of the same type, which are clamped between two bottom elements by means of tie-rods. The plates possess in their angles openings which define in the stack inlet and outlet passages for the two fluids. Alternation of the fluids in the successive spaces between the plates is obtained thanks to seals of appropriate shape.

Such exchangers present very good thermal performances for small dimensions.

However, due to the presence of seals, they cannot be used when it is desired to work at high temperature and high pressure.

French Pat. No. 1 125 663 and British Pat. No. 838 466 also propose heat exchangers incorporating independent fluid circuits constituted by juxtaposed plates disposed inside an enclosure defining independent chambers for each of the fluids, so as to form superposed channels which open out alternately in the lateral fluid circulation chambers, these channels extending over the whole width of the unit.

Numerous problems are posed in such an embodiment, namely that of the connection of the different plates to one another to form the superposed channels and that of the connection with the uprights or the like to which are fixed the lateral walls intented to form, in cooperation with said uprights and connected edges of the plates, the fluid circulation chambers. Among the solutions to this problem, mention may be made of the type of exchanger marketed for a very long time by Applicants and which is constituted by parallelepipedic blocks of graphite in which are pierced two series of channels forming circuits which are totally independent for the two fluids. These blocks present the advantage of being able to be mass-produced and of being interchangeable. Furthermore, as they are in the form of modules, they may be combined as a function of the particular applications for which the exchanger must be made. However, this type of modular exchanger presents the drawback of being made of graphite, of having a low mechanical strength and a resistance to temperature limited to 220° C.

SUMMARY OF THE INVENTION

A novel type of exchanger with independent fluid circuits has now been found, and this is what forms the subject matter of the present invention, which not only presents the advantages of the exchangers constituted by modular parallelepipedic blocks of the type mentioned above, but also enables a compact assembly to be obtained, presenting a large heat exchange surface in manner similar to plate exchangers whilst solving the problems posed by such exchangers, namely in particular that of resistance to high pressures. Furthermore, the exchanger according to the invention makes it possible simply to produce independent chambers for each of the fluids and does not require the use of seals to ensure tightness.

The exchanger according to the invention, incorporating independent fluid circuits, is generally of the type constituted by modular elements in the form of blocks maintained juxtaposed inside an enclosure defining independent chambers for each of the fluids, each block presenting superposed channels opening alternately in the lateral fluid circulation chambers, these channels extending over the whole width of the block.

The exchanger according to the invention is characterized in that the channels are defined by the space included between pressed plates, comprising edges turned back through 90° alternately in opposite direction and which form, in each angle, a vertical edge enabling them to be fixed to the lateral walls defining fluid circulation chambers, said plates being associated with one another by butt-welding of the ends of the bent edges and the vertical edges. The fixation to the lateral walls is realized either directly by welding the vertical edges to said walls or indirectly by means of uprights on which are fixed the lateral walls.

The channels are advantageously parallelepipedic in form and are constituted from pressed plates which are then welded to form a monobloc parallelepiped of which the number of channels is adapted to the technical problems to be solved.

The space between two plates and which therefore forms the channel may either be entirely free or may possibly comprise reinforcing elements such as connecting barbs.

Profiled interposed plates may also be introduced inside the channels, these plates making it possible not only to perform the role of a reinforcing element increasing the strength of the exchanger but also to control the turbulence of the fluids and their pressure drop and to improve the coefficient of heat exchange.

The plates may be directly pressed with one or more special profiles of grooves, eliminating the interposed plates. In that case, the stamped profile simultaneously ensures mechanical strength by numerous bearing points and distribution of the fluids.

As has been mentioned hereinabove, the pressed plates defining the channels have a configuration such that they present in each angle a vertical edge. This edge makes it possible either to fix the plates in uprights on which are fixed the lateral walls proper, said walls preferably mounted in dismountable manner, or to fix the plates directly to the lateral walls by welding. The walls channel the fluids and define the number of passages, i.e. the number of channels used upon each passage to obtain the maximum speed compatible with the pressure drops. The height of the channels (space between two consecutive plates) will be determined as a function of the conditions of operation (5 mm, 10 mm, 15 mm, 20 mm, . . . ).

A heat exchanger may be constituted either entirely by channels of homogeneous height, or possibly by channels of different heights on each circuit.

BRIEF DESCRIPTION OF THE DRAWINGS

The invention will be more readily understood on reading the following description with reference to the accompanying drawings, in which.

DETAILED DESCRIPTION OF THE INVENTION

Figure 1:
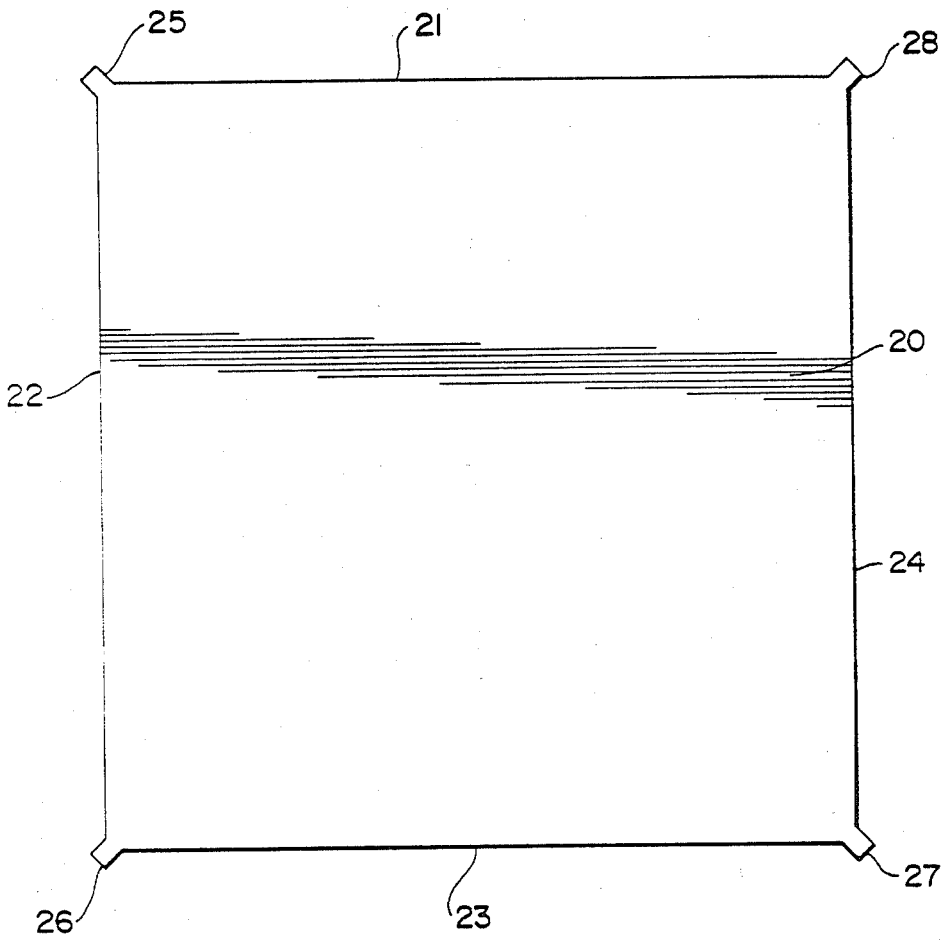
FIG. 1 is a plan view of an elementary plate, before pressing, for making an exchanger according to the invention.

Referring now to the accompanying drawings and more particularly to FIGS. 5 to 8, the exchanger according to the invention is of the type constituted by modular elements maintained juxtaposed inside an enclosure, elements of which the structure according to the invention will be seen in greater detail in the following description. These modular elements generally designated by reference M will be maintained juxtaposed via four rigid uprights 1, 2, 3, 4. These rigid uprights support walls 5, 6, 7, 8 preferably mounted in removable manner, for example by means of screws, on said uprights. The walls form in association with the uprights independent chambers 9,10,11,12 for each of the fluids. Inlet conduits 13,14 and outlet conduits 15,16 for each of the fluids are provided in the walls. The fluids may, of course, flow either in the same direction or in opposite directions. In the present case, the walls 5,6,7, 8 define with the blocks chambers of parallelepipedic shape but it is obvious that this is not limiting.

Bottom elements 17,18 are disposed at each end and maintain the elementary blocks against one another. These bottom elements are mounted in tight manner on the walls.

Figure 3:
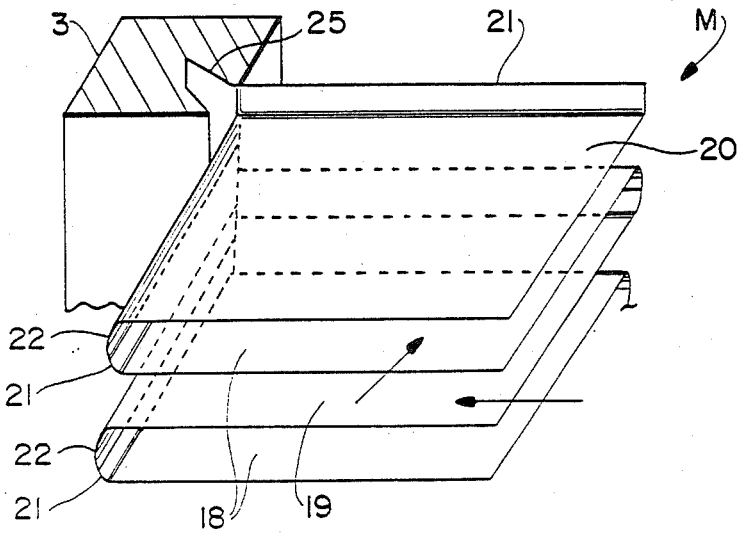
FIG. 3 is a partial view in perspective showing the manner in which the channels of an exchanger according to the invention are made from the elementary plates.
Figure 4:
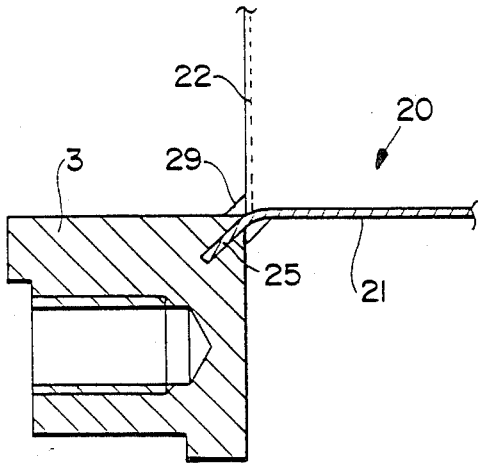
FIG. 4 is a view in section showing the fixation of said channels to the uprights, enabling them to be connected to form the exchanger.

According to the invention, the blocks 1 inside which the fluids circulate are characterized, as is clearly apparent in FIG. 3, in that they present superposed channels 18,19 opening out alternately in the lateral chambers and extending over the whole width of each block.

Figure 2:
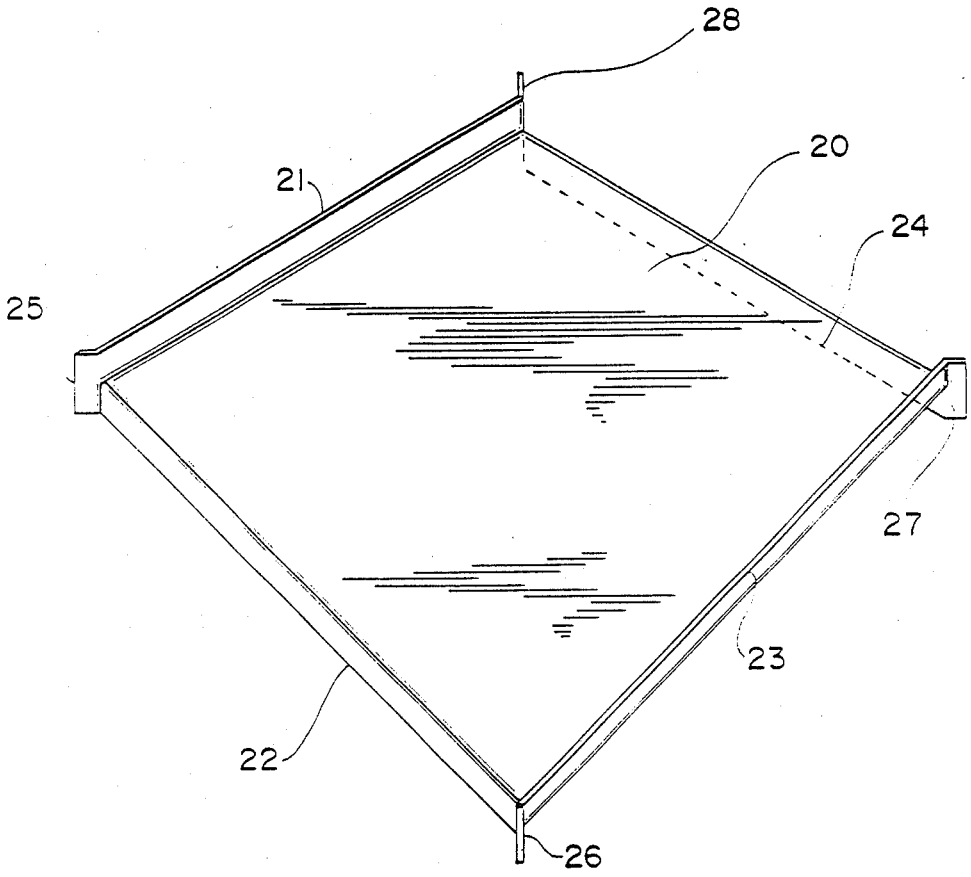
FIG. 2 is a view in perspective showing the structure of this plate after pressing.

These channels are parallelepipedic in form and are constituted by the space between pressed plates, designated by general reference 20, made in the manner illustrated in FIGS. 1 and 2. Each elementary plate 20, whose dimensions are a function of the type of exchanger to be made, is firstly cut out in the configuration shown in FIG. 1, so as to present four sides 21,22,23,24, each angle comprising a projecting tongue 25,26,27,28. The plates are made from any pressable and weldable metals such as for example steel, stainless steel, titanium, zirconium, . . .

Figure 10:
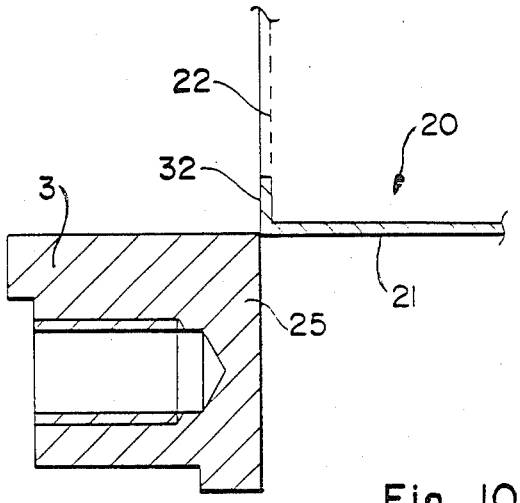
FIG. 10 is a cross-sectional view showing the plates secured to the walls of the heat exchanger.

The plate thus made is then pressed in the manner illustrated in FIG. 2, so that the edges are bent through 90° alternately in opposite direction and the tongues form, in each angle, a vertical edge. To obtain a block according to the invention, it therefore suffices, as shown in FIG. 3, to superpose elementary plates thus pressed and to weld them together along the bent edges and the vertical edges. Alternating channels 18,19, intersecting with respect to one another and channels closed on two sides are thus obtained. The actual block is produced by inserting the edges, 25 for example, in a rigid upright 3 for edge 25. A welding bead 29 is made to ensure tightness at the level of the upright. Alternatively, the vertical edges 25 can be welded directly to the wall of the enclosure using welds 32 as shown in FIG. 10.

By superposing a plurality of blocks in this way, it is therefore possible to obtain an exchanger which is perfectly adapted to the problems to be solved.

Figure 5:
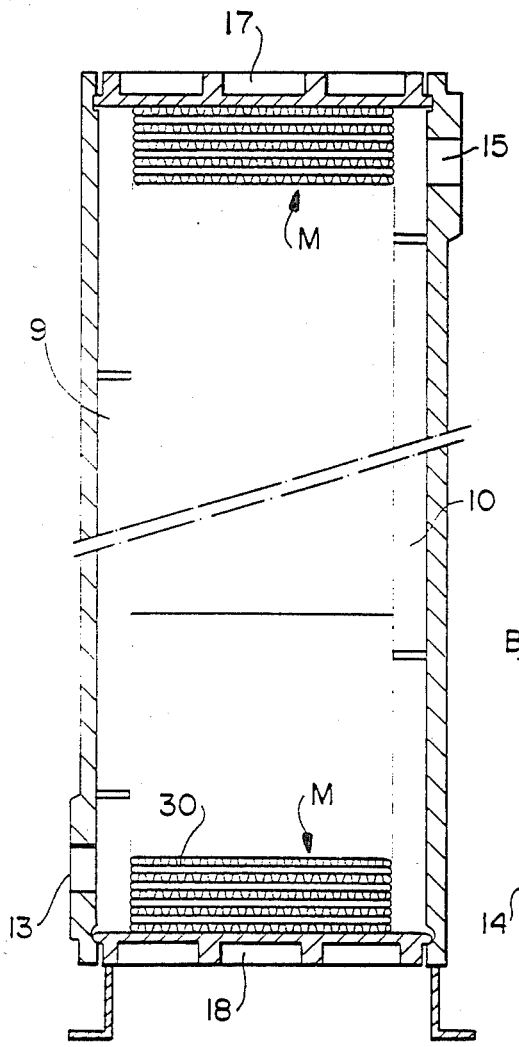
FIGS. 5, 6, 7 and 8, respectively, are views in elevation, in section along axis AA, along axis BB and in plan view of an exchanger made according to the invention.
Figure 6:
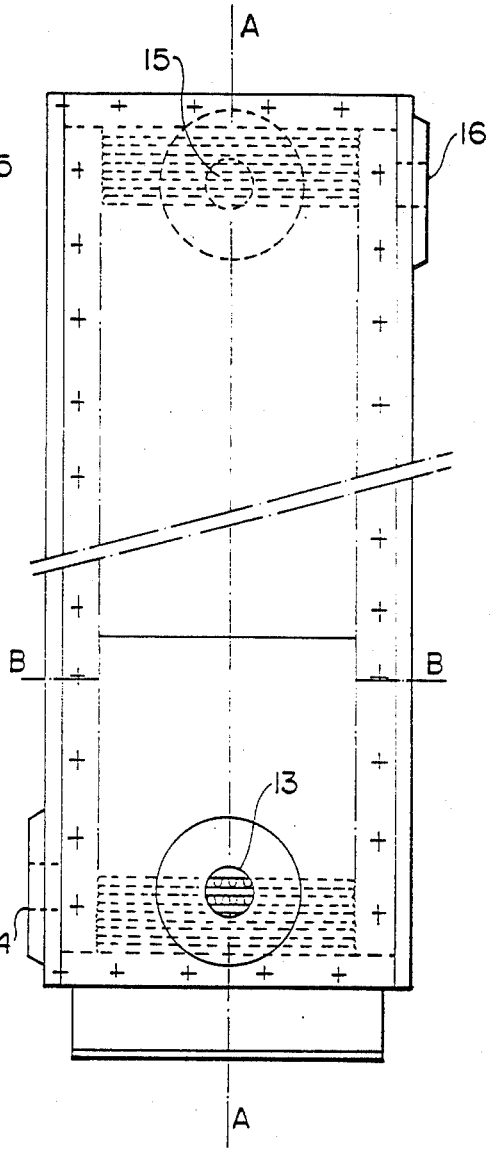
Figure 7:
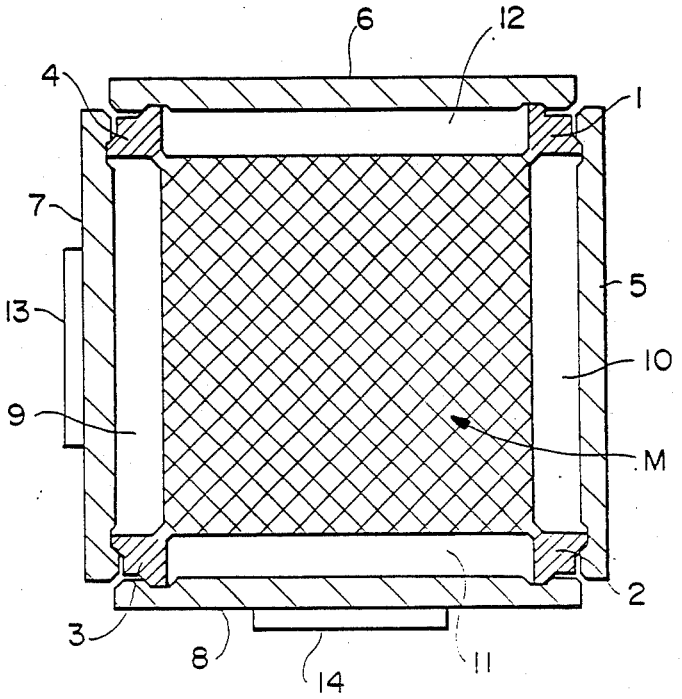
Figure 8:
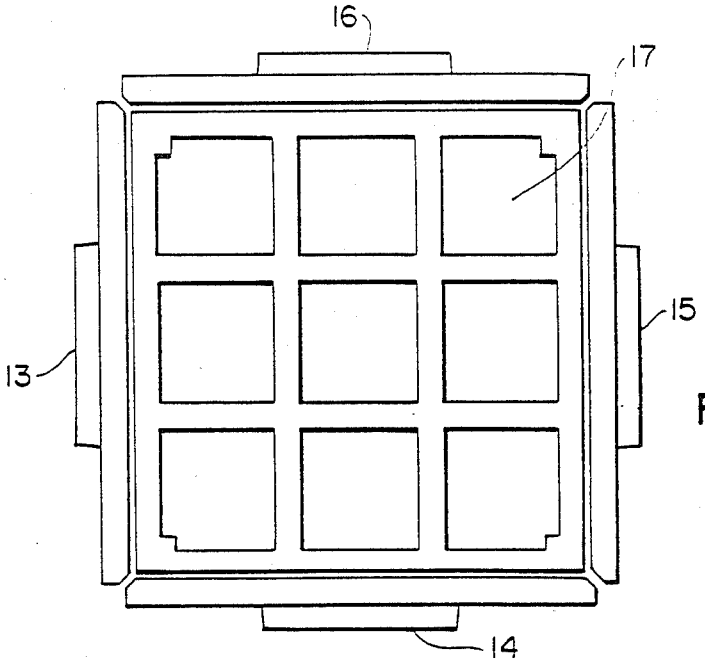

It may be possible to reinforce the resistance between the plates by providing barbs, as shown in FIG. 5 for connecting between two consecutive plates within the channels.

Similarly, as shown in FIG. 5, additional plates 30, for example corrugated ones, may be inserted in the channels formed, which not only perform the role of a reinforcing element increasing the resistance, but also control the turbulence of the fluids and their pressure drop and improve the coefficient of heat exchange. In such a variant, cleaning of the assembly is facilitated by the fact that said interposed plates may easily be removed.

Figure 9:
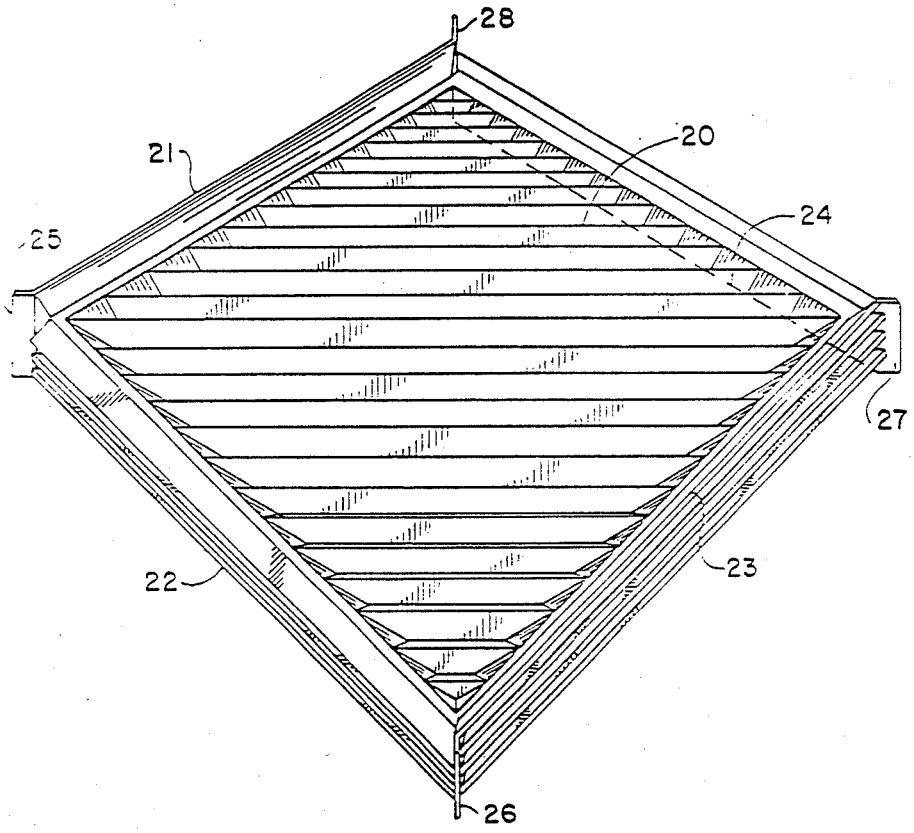
FIG. 9 is a perspective view showing the plate with grooves after being pressed.

Although the surface of the plates defining the fluid circulation channels may be smooth, it may be envisaged to make pressed plates with one or more special groove profiles. Such an embodiment is shown in FIG. 9. In that case, the profile of pressing simultaneously ensures mechanical strength by numerous bearing points and distribution of the fluids. The profile may for example be in the form of corrugations disposed obliquely, for example at 45° with respect to the sides of the plates. It is thus possible to modify the distribution of the fluids as a function of the manner in which the plates are superposed with respect to one another.

With respect to prior known plate exchangers and/or modular exchangers, the exchanger according to the invention presents numerous advantages, for example those of:

being easily adapted to the technical problems to be solved, in that it is constituted by standard elements obtained by simple pressing, which are then welded to form a monobloc parallelepiped of which the number of channels may be variable;

of presenting, as has already been mentioned, two independent circuits which may be cleaned and inspected perfectly well;

of being able to combine, in the same exchanger, channels of different height on each circuit;

of allowing simple, rapid assembly, eliminating any O-ring, with the uprights on which are fixed the lateral walls defining the fluid circulation chambers;

of presenting a very high resistance to pressure.

The exchangers may be used both vertically and horizontally and may receive gases or liquids and find applications in numerous domains (chemistry, heating of dwellings, agricultural chemistry, . . . ).

They may be used in refrigerators, evaporators, heating tubes, condensers and may present one or two circuits which are entirely tight without-O-ring.

The invention is, of course, not limited to the embodiment described hereinabove, but covers all the variants made in the same spirit. For example, although it is advantageous to make the elementary plates by pressing, any other technique enabling an equivalent structure to be obtained from a plate may be envisaged.

The same applies to the distribution of the fluids. The dismountable chambers may be replaced by welved chambers eventually directly to the edges, the exchanger may be in any form, such as cylindrical or rectangular and be assembled by identical or different modules.

What is claimed is:

1. A heat exchanger including independent fluid circuits, said heat exchanger comprising:

modular elements in the form of blocks maintained juxtaposed inside an enclosure, said enclosure comprising lateral walls and a plurality of blocks which define a plurality of independent lateral fluid chambers, each block defining superposed channels, adjacent ones of said superposed channels opening out alternately into one of said plurality of lateral fluid chambers, said channels extending over the whole width of the block, each of said plurality of blocks comprising a plurality of substantially identical elemental plates, each of said elemental plates including a plurality of horizontal edges turned back through 90° alternately in opposite directions, adjacent horizontal edges forming an angle therebetween, a vertical edge being formed in each said angle enabling said blocks to be fixed to the lateral walls, said plates being associated with one another by butt-welding ends of the horizontal edges of the vertical edges.

2. The heat exchanger of claim 1, wherein the vertical edges are welded directly to the lateral walls.

3. The heat exchanger of claim 1, wherein said lateral walls comprise uprights, said vertical edges being fixed to said uprights.

4. The heat exchanger of claim 1, wherein the channels are parallelepipedic in form.

5. The heat exchanger of claim 1, further comprising reinforcing elements disposed inside each channel.

6. The heat exchanger of claim 5, wherein the reinforcing elements comprise barbs spaced from one another.

7. The heat exchanger of claim 5, wherein the reinforcing elements comprise removable, profiled interposed plates, said interposed plates functioning to control the turbulence and pressure drop of fluids flowing in said heat exchanger, and to improve the coefficient of heat exchanger.

8. The heat exchanger of claim 1, wherein the elemental plates are substantially flat.

9. The heat exchanger of claim 1, wherein the elemental plates are profiled so as to form a plurality of abutting grooves which ensure mechanical strength and even distribution of fluids.

10. A heat exchanger comprising:

an enclosure including lateral walls, an upper element and a bottom element; and a plurality of blocks positioned within said enclosure, each of said plurality of blocks comprising a plurality of substantially identical elemental plates, each of said elemental plates including a surface, four horizontal edges and four vertical edges, each of said four horizontal edges being alternatively turned in opposite directions at right angles to said surface, said vertical edges being defined between adjacent ones of said horizontal edges, said vertical edges being fixed to said lateral walls thereby securing said blocks to said lateral walls.

11. The heat exchanger of claim 10, wherein said horizontal edges of adjacent ones of said plurality of elemental plates are juxtaposed.

12. The heat exchanger of claim 10, wherein adjacent ones of said plurality of elemental plates define channels therebetween.

13. The heat exchanger of claim 12, wherein said enclosure defines a plurality of independent lateral fluid chambers, each of said channels being in communication with at least one of said plurality of independent lateral fluid chambers.

14. The heat exchanger of claim 10, wherein said lateral walls comprise uprights, said vertical edges being fixed to said uprights.

15. The heat exchanger of claim 10, further comprising reinforcing elments positioned between adjacent ones of said plurality of elemental plates.

16. The heat exchanger of claim 10, wherein said surface of each of said plurality of elemental plates is profiled so as to form a plurality of abutting grooves.

17. The heat exchanger of claim 15, wherein said reinforcing elements comprise barbs.

18. The heat exchanger of claim 15, wherein said reinforcing elements comprise removable profiled interposing plates.

* * * * *